US012188310B2

(12) United States Patent
Hellvik et al.

(10) Patent No.: US 12,188,310 B2
(45) Date of Patent: Jan. 7, 2025

(54) DEVICE, SYSTEM AND METHOD FOR HIGH SPEED DATA TRANSFER

(71) Applicant: National Oilwell Varco Norway AS, Kristiansand S (NO)

(72) Inventors: Svein Hellvik, Lillehammer (NO); Morten Welmer, Sola (NO)

(73) Assignee: National Oilwell Varco Norway AS (NO)

( * ) Notice: Subject to any disclaimer, the term of this patent is extended or adjusted under 35 U.S.C. 154(b) by 0 days.

(21) Appl. No.: 17/768,661

(22) PCT Filed: Oct. 15, 2020

(86) PCT No.: PCT/NO2020/050254
§ 371 (c)(1),
(2) Date: Apr. 13, 2022

(87) PCT Pub. No.: WO2021/075977
PCT Pub. Date: Apr. 22, 2021

(65) Prior Publication Data

US 2024/0110450 A1 Apr. 4, 2024

(30) Foreign Application Priority Data

Oct. 17, 2019 (EP) ..... 19203843

(51) Int. Cl.
*E21B 19/16* (2006.01)
*E21B 17/02* (2006.01)

(52) U.S. Cl.
CPC ..... *E21B 19/16* (2013.01); *E21B 17/028* (2013.01)

(58) Field of Classification Search
CPC .... E21B 17/028; E21B 17/0283; E21B 19/00; E21B 19/02; E21B 19/06;
(Continued)

(56) References Cited

U.S. PATENT DOCUMENTS

2010/0243324 A1 9/2010 Veeningen et al.
2011/0297445 A1* 12/2011 Clemens ..... E21B 3/02 175/85

(Continued)

OTHER PUBLICATIONS

International Search Report and Written Opinion dated Jan. 14, 2021, for Application No. PCT/NO2020/050254.

(Continued)

*Primary Examiner* — Tara Schimpf
*Assistant Examiner* — Lamia Quaim
(74) *Attorney, Agent, or Firm* — Conley Rose, P.C.

(57) ABSTRACT

In some examples, an apparatus for coupling and decoupling a connector head to and from an end of a wired drill pipe held by an elevator includes an actuator configured to move the connector head between a coupled position and a decoupled position. The actuator is configured to move the connector head in parallel with the longitudinal axis of the wired drill pipe before moving it away from said wired drill pipe when decoupling the connector head from the wired drill pipe, and to move the connector head into the longitudinal axis of the wired drill pipe before moving it in parallel with said longitudinal axis when coupling the connector head to the wired drill pipe.

9 Claims, 4 Drawing Sheets

(58) Field of Classification Search
CPC .. E21B 19/16–168; E21B 41/00; E21B 47/12; E21B 47/13
See application file for complete search history.

(56) References Cited

U.S. PATENT DOCUMENTS

| | | | |
|---|---|---|---|
| 2013/0199845 | A1 | 8/2013 | Zaleski, Jr. et al. |
| 2014/0144651 | A1 | 5/2014 | Lamik-Thonhauser et al. |
| 2016/0047180 | A1 | 2/2016 | Belik |

OTHER PUBLICATIONS

International Preliminary Report on Patentability dated Sep. 23, 2021 for Application No. PCT/NO2020/050254.

* cited by examiner

DEVICE, SYSTEM AND METHOD FOR HIGH SPEED DATA TRANSFER

CROSS-REFERENCE TO RELATED APPLICATIONS

This application is a 35 U.S.C. § 371 national stage application of PCT/NO2020/050254 filed Oct. 15, 2020, and entitled "Device, System and Method for High Speed Data Transfer" which claims priority to European patent application No. 19203843.8 filed Oct. 17, 2019, both of which are hereby incorporated herein by reference in their entirety.

TECHNICAL FIELD

The present description relates to an apparatus for coupling and decoupling a connector head to and from an end of a wired drill pipe held by an elevator, and to a method for coupling a connector head to an end of a wired drill pipe held by an elevator.

BACKGROUND

When drilling a wellbore, data is typically acquired from sensors on the drill string for a range of purposes such as decision-support to monitor and manage the smooth operation of drilling, to make detailed records or well logs of the geologic formations penetrated by a borehole, to generate operations statistics and performance benchmarks such that improvements can be identified, and/or to provide well planners with accurate historical operations-performance data with which to perform statistical risk analysis for future well operations. As the wellbore can be several kilometers deep, the data must be sent to the surface.

A common technique used to send data to the surface is mud-pulse telemetry, where a valve downhole creates pressure fluctuations in the drilling mud. As the pressure fluctuations reach the surface, they are detected by pressure sensors and converted to information. A disadvantage of mud-pulse telemetry is that speed of the data transfer is very low. Therefore, wired drill pipe systems are being developed, wherein electrical wires are built into each section of the drill string. Wired drill pipe systems allow for a much higher speed of the data transfer. However, a disadvantage of the wired drill pipe system known today is as it requires the top drive to be connected to the drill string for the information to be read and processed by the surface data system. The system is therefore not able to obtain data from the wellbore during e.g. tripping, where the drill string is pulled out of and/or run into the wellbore, since the top drive is disconnected from the drill string at this stage.

As a solution to this problem, it has been proposed to attach a communication sub to the end of a wired drill pipe during tripping. For example, U.S. Pat. No. 8,462,013 B2 discloses an apparatus for coupling a communication sub to a wired drill pipe, wherein the apparatus comprises vertical and lateral adjustment arms for positioning and attaching the communication sub relative to the receiving end of a pipe. A disadvantage of this apparatus is that the configuration with the adjustment arms causes the apparatus to be heavy and inconvenient during operation, and that it requires multiple actuators to initiate the movement of the arms. Additionally, different pipe sections may protrude at different heights relative to the elevator, so the adjustment arms may not be able to reach the pipe end and/or correctly position the communication sub in said pipe end.

US patent application US2016/047180A1 and US patent application US2013/199845A1 disclose alternative solutions.

SUMMARY

The apparatus and method of the present description have for its object to remedy or to reduce at least one of the drawbacks of the prior art, or at least provide a useful alternative to prior art. The object is achieved through features which are specified in the description below and in the claims that follow.

The apparatus and method of the present description are defined by the independent patent claims, while the dependent claims define advantageous embodiments of the apparatus and the method.

Some examples relate more particularly to an apparatus for coupling and decoupling a connector head to and from an end of a wired drill pipe held by an elevator. The apparatus includes an actuator configured to move the connector head between a coupled position, where the connector head is coupled to the end of the wired drill pipe, and a decoupled position, where the connector head is displaced from the longitudinal axis of said wired drill pipe. The actuator is configured to move the connector head in parallel with the longitudinal axis of the wired drill pipe before moving it away from said wired drill pipe when decoupling the connector head from the wired drill pipe, and to move the connector head into the longitudinal axis of the wired drill pipe before moving it in parallel with said longitudinal axis when coupling the connector head to the wired drill pipe.

The connector head may have an applicable data read and transfer system, and the data may be transferred from the connector head to the surface data system using e.g. a cable or a wireless system. The apparatus may typically be used while tripping, since the top drive is not connected to the wired drill pipe at this stage as mentioned above. By moving the connector head to the decoupled position when it is not coupled to the wired drill pipe, it is ensured that the connector head is not hindering the access to the end of the wired drill pipe when decoupled from said wired drill pipe.

Different wired drill pipes may protrude to different heights above the elevator, for example due to different lengths of the shoulder of the wired drill pipe which the elevator uses for support when lifting said wired drill pipes. Since the apparatus is configured to move the connector head substantially in parallel with the longitudinal axis of the wired drill pipe in a region above the end of said wired drill pipe when it is supported by the elevator, it is ensured that the connector head will be coupled correctly to the end of the wired drill pipe even if said end protrudes further or less from the elevator than expected. The apparatus may for example include a force sensor which measures the force on the connector head or connector arm. In this way it may easily be detected when the connector head is coupled to the end of the wired drill pipe, whereby the apparatus will know when to stop the movement of the connector head. Alternatively, or additionally, the movement may be stopped when data from the wired drill pipe are received. There may be a maximum height at which the apparatus will work, but this maximum height depends on the dimension of the apparatus which can be constructed such that it will function for all desired protrusion heights. To be further compliable with different types of elevators, the apparatus may be constructed such that the distance from the actuator to the connector head may be varied. For example, the connector arm may be telescopic, or the connector head may be slidably attached to the connector arm.

In some examples, the apparatus effectively comprises a hydraulic cylinder for being positioned substantially in parallel with the longitudinal axis of the wired drill pipe, and a guiding means for guiding the movement of the connector head as the piston is moving axially within and relative to said hydraulic cylinder. This will be a simple solution which will ensure that the movement will be parallel to the longitudinal axis of the wired drill pipe in the region above and close to the wired drill pipe. Another possible way of creating the linear/rotational motion may be by using an electric/pneumatic linear actuator. If a hydraulic cylinder is used, this may for example comprise a hydraulic fluid on both sides of the piston, or it may comprise a gas accumulator on one side. If the hydraulic cylinder comprises a gas accumulator, hydraulic fluid may be used to press the piston against the gas when coupling the connector head to the wired drill pipe, while expansion of the gas may press the piston opposite to decouple the connector head if pressure on the hydraulic fluid is decreased.

The guiding means causes, in a part of the movement of the connector head, said connector arm to rotate around the cylinder axis while simultaneously moving axially relative to said cylinder axis. In this way the connector arm will automatically move the connector head away from or towards the longitudinal axis of the wired drill pipe as the piston is displaced along the cylinder, thereby converting axial movement of the piston to both axial and rotational movement of the connector head. This movement may for example be obtained by a groove of the desired shape in a part of the actuator and an inward protrusion in a base of the connector arm which engages the groove. The base portion of the arm may for example be a hollow cylinder which can slide on the hydraulic cylinder or another part of the actuator. The hollow cylinder may be connected to the piston of the hydraulic cylinder, for example via a piston rod. The piston rod may exit the hydraulic cylinder in a cylindrical rod housing. The base portion of the connector arm may be slidably and rotationally connected to the cylindrical road housing. The connector arm may for example rotate 90 degrees around the axis of the hydraulic cylinder to move the connector head away from or towards the region above the end of the wired drill pipe along the axis of said wired drill pipe.

In some examples, the apparatus may be configured to be attached to a drilling bail using a suitable connection means. As drilling bails are typically used on drilling rigs, this will make the apparatus easily connectable to different drilling rigs. This may be especially advantageous if the actuator comprises a hydraulic cylinder, as it can be connected in parallel to the drilling bail and will thereby not take be in the way during other work processes. The connection means may for example comprise a first part which is securely fastened to the drilling bail and which is not easily removed, e.g. clams, and a second part which is fastened to the first part in an easier releasable way. The connection may for example comprise clamps which are tightly fastened to the drilling bail and intended to stay fastened to the bail also if the apparatus is disconnected. Alternatively, the connection means may comprise a connection device as known in the art for quick connection, where the connection device is approved for overhead mounting and meets all dropped objects requirements and regulations. The connection means may be configured to reduce the risk of objects falling from the connection means during attachment or detachment of the apparatus to or from the drilling bail.

In some examples, the apparatus may comprise a safety mechanism for quickly moving the connector head from the coupled position to the decoupled position. In this way damage of the apparatus may be avoided in case the wired drill pipe suddenly rises relative to the elevator. This may for example happen if the wired drill pipe is being run into the hole and suddenly gets stuck, even temporarily, since the elevator is moving downward and does not stop immediately. If the connector head and arm is not removed quickly from the end of the wired drill pipe, the apparatus may be damaged. Preferably, the apparatus will comprise a means for detecting if the pipe is moving upwards relative to the elevator, for example a pressure sensor on the connector head or tension sensor in the connector arm. Thereby, if a pressure larger than a pre-set threshold is exceeded, the safety mechanism will be triggered, and the connector head and arm will be moved out of the way of the rising pipe. Alternatively, the safety mechanism may be triggered by the rig's control system running the hydraulic and/or electrical systems by measuring a decrease in hook load.

The safety mechanism may for example comprise a gas accumulator, wherein gas will be compressed when the actuator is moving the connector head from the decoupled to the coupled position. The gas will thereby function as a compression spring which will expand rapidly and cause the connector head to be moved if the force on the gas is released. For example, if the actuator is a hydraulic cylinder, a hydraulic fluid on one side of the piston may be used to press the piston towards the gas accumulator and compress the gas. If the safety mechanism is triggered, a valve may be opened which allows the hydraulic fluid to escape the cylinder. In this way the pressure on the hydraulic fluid and the piston is decreased, whereby the gas will expand rapidly while pressing the hydraulic fluid through the valve and at the same time causing the connector head to move rapidly to the decoupled position. As an alternative to the gas accumulator, the safety mechanism may comprise a mechanical biasing means, such as a spring, which will function in a similar way.

In other examples, a method is provided. The method is for coupling a connector head to an end of a wired drill pipe held by an elevator, wherein the method comprises the steps of: a) moving the connector head from a position where the connector head is displaced from the longitudinal axis of the wired drill pipe to a position along the longitudinal axis of the wired drill pipe and displaced from said wired drill pipe, and b) moving the connector head along the longitudinal axis of the wired drill pipe onto the end of said wired drill pipe. An advantage of this method is that the connector head will be correctly coupled to wired drill strings which protrude to different heights above the elevator, for example due to different lengths of the shoulder of different drill strings. Step a) may be performed by transforming a translational movement of an actuator into a translational and rotational movement of the connector head. This will be a relatively simple way to move the connector head into the axis of the wired drill pipe. Furthermore, both steps a) and b) may be performed by translational movement of the actuator, whereby only one actuator is needed to perform both steps. In this way the method ay be performed be relatively simple instruments that can be made small and lightweight, which is a great advantage e.g. on offshore oil rigs. In various examples, the method may be performed using the apparatus of the present description.

BRIEF DESCRIPTION OF DRAWINGS

In the following is described an example illustrated in the accompanying drawings.

DETAILED DESCRIPTION

Figure 1:
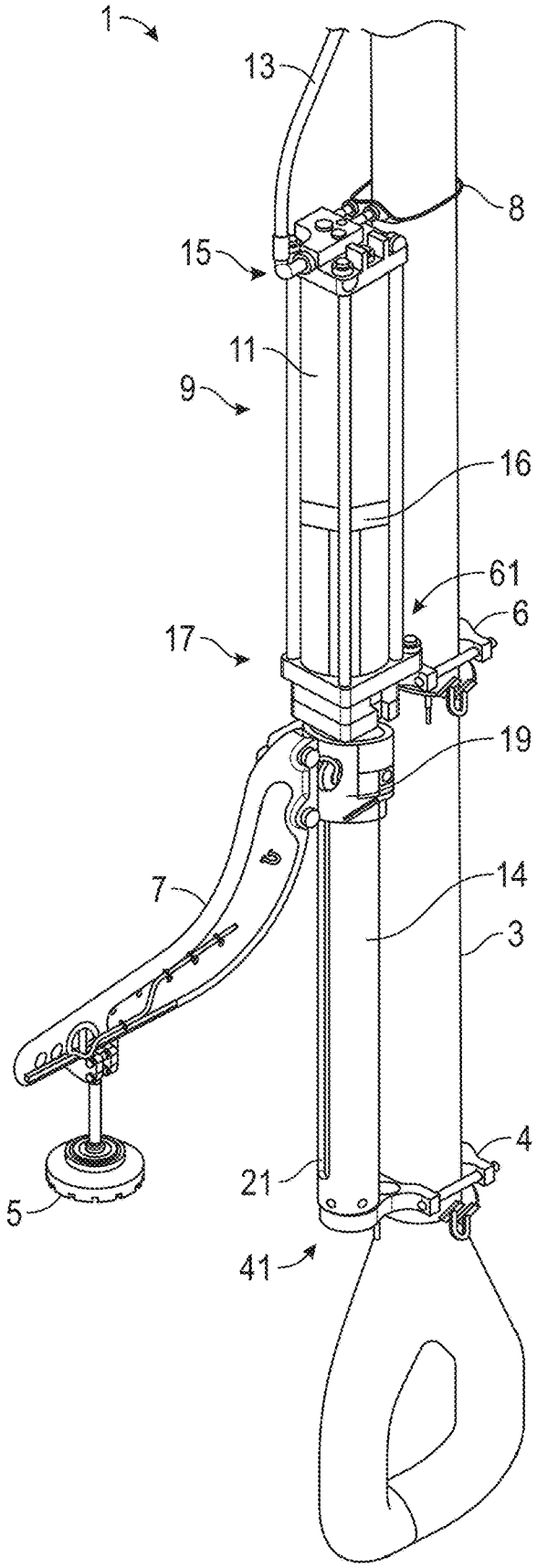
FIG. 1 shows an apparatus according to the present description mounted on a drilling bail, wherein the connector head is in the decoupled position.

In the drawings, the reference numeral 1 indicates an apparatus. Identical reference numerals indicate identical or similar features in the drawings. The drawings are presented in a simplified and schematic manner, and the features therein are not necessarily drawn to scale.

FIG. 1 shows an apparatus 1 mounted on a drilling bail 3 via two pairs of clamps 4, 6 which are tightly fastened to the bail 3 using bolts. The apparatus 1 is connected to the clamp 6 using bolts (position of this connection indicated by the arrow 61) and shaped to fit into a complementary recess 41 of the clamp 4. The apparatus 1 may in this way relatively easy be connected to and disconnected from the bail 3 via the clamps 4, 6, while the clamps 4, 6 may be left on the bail 3 as they do not take up any significant space. As an additional safety mechanism, a wire 8 connects the apparatus 1 to the bail 3 in case the connections 41, 61 or clamps 4, 6 malfunctions or gets disconnected unintentionally. The apparatus 1 comprises a connector head 5 connected to one end of a connector arm 7, the other end of the connector arm 7 being connected to an actuator 9. In the shown embodiment, the actuator 9 comprises a hydraulic cylinder 11 comprising a piston inside (not visible in the figures) and a piston rod 12 (visible in FIGS. 2 and 4) protruding out of the hydraulic cylinder 11 and into a cylindrical rod housing 14. The cylindrical rod housing 14 may be rotated while sitting in the recess 41 by loosening screws in the lower part of the hydraulic cylinder 11. In this way the arm 7 may be aligned with a wired drill pipe (25, shown in FIG. 3) held by an elevator (27, shown in FIG. 3). A hose 13 allows hydraulic fluid to be injected into and out of the cylinder 11 on a piston side 15 of the hydraulic cylinder 11. The rod side 17 of the cylinder 11 is in communication with a compressible gas. When hydraulic fluid is injected into the cylinder 11 on the piston side 15, the piston will be displaced towards the rod side 17, and the gas will be compressed. The connector arm 7 comprises a base portion 19 which is slidably connected to the rod housing 14 and rotatably connected to the piston rod 12. An inward protrusion (not visible in the figures) on the base portion 19 engages a groove 21 in the rod housing 14, whereby the rotation of the base portion 19 of the connector arm 7 upon axial displacement of the piston rod 12 follows the shape of the groove 21. Thus, in the shown embodiment, and better illustrated and explained in FIG. 2, axial displacement of the piston rod 12 leads to both rotational and axial displacement of the base portion 19.

Figure 2:
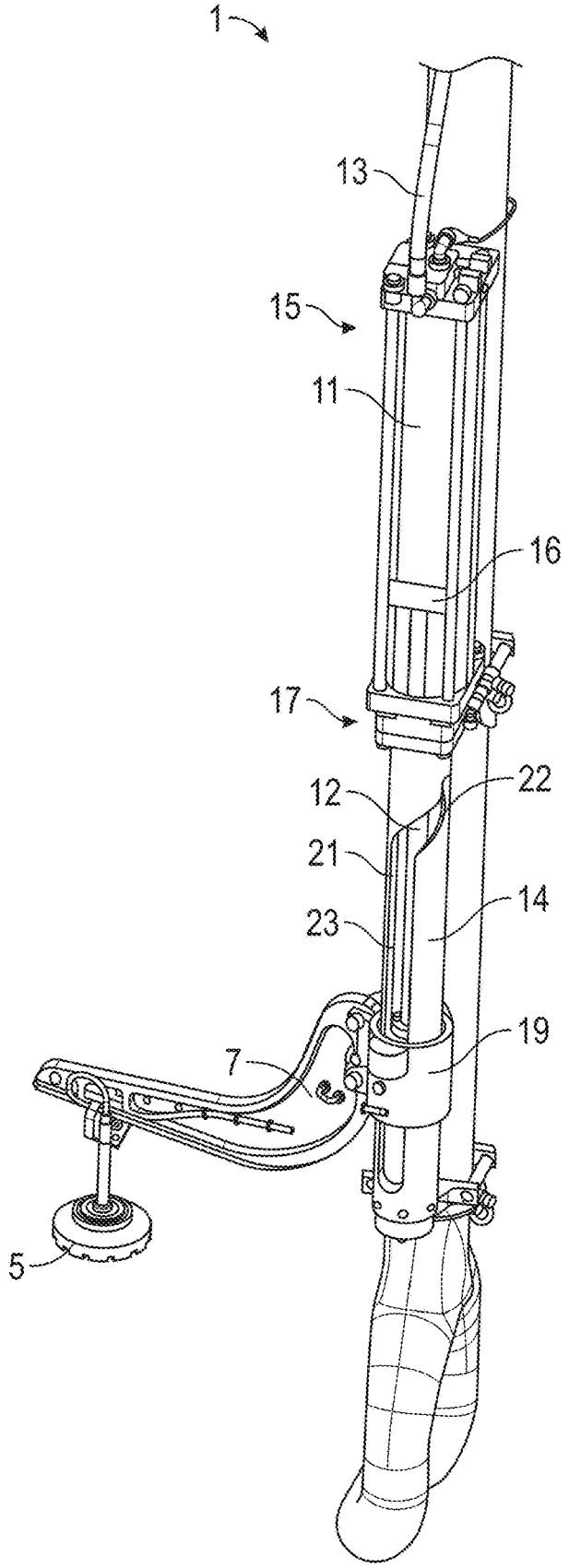
FIG. 2 shows the apparatus of FIG. 1, wherein the connector head is in the coupled position.

FIG. 2 shows the apparatus 1 of FIG. 1 viewed from a slightly different angle, wherein the piston is displaced axially inside the hydraulic cylinder 11. Displacement of the piston has caused the piston rod 12 to be displaced inside the cylindrical rod housing 14, and thereby also the base portion 19 of the connector arm 7 to be displaced along the rod housing 14. The displacement of the piston is caused by hydraulic fluid which has been pumped via the hose 13 into the hydraulic cylinder 11 on the piston side 15. The shape of the groove 21, with which the inward protrusion on the base portion 19 is engaged, determines rotation of the base portion 19 and the connector arm 7 around the axis of the cylindrical rod housing 14 as the piston is being displaced along the axis of the hydraulic cylinder 11. In an upper portion 22, the groove 21 has a shape which is similar to a sigmoidal curve, i.e. S-shaped, whereby the base portion 19, the connector arm 7, and the connector head 5 are rotated around the axis of the cylindrical rod housing 14 while being displaced axially along said cylindrical rod housing 14. In a lower portion 23, the groove 21 is parallel to the axis of the cylindrical rod housing 14, whereby the base portion 19, connector arm 7, and connector head 5 are displaced in parallel to said axis.

Figure 3:
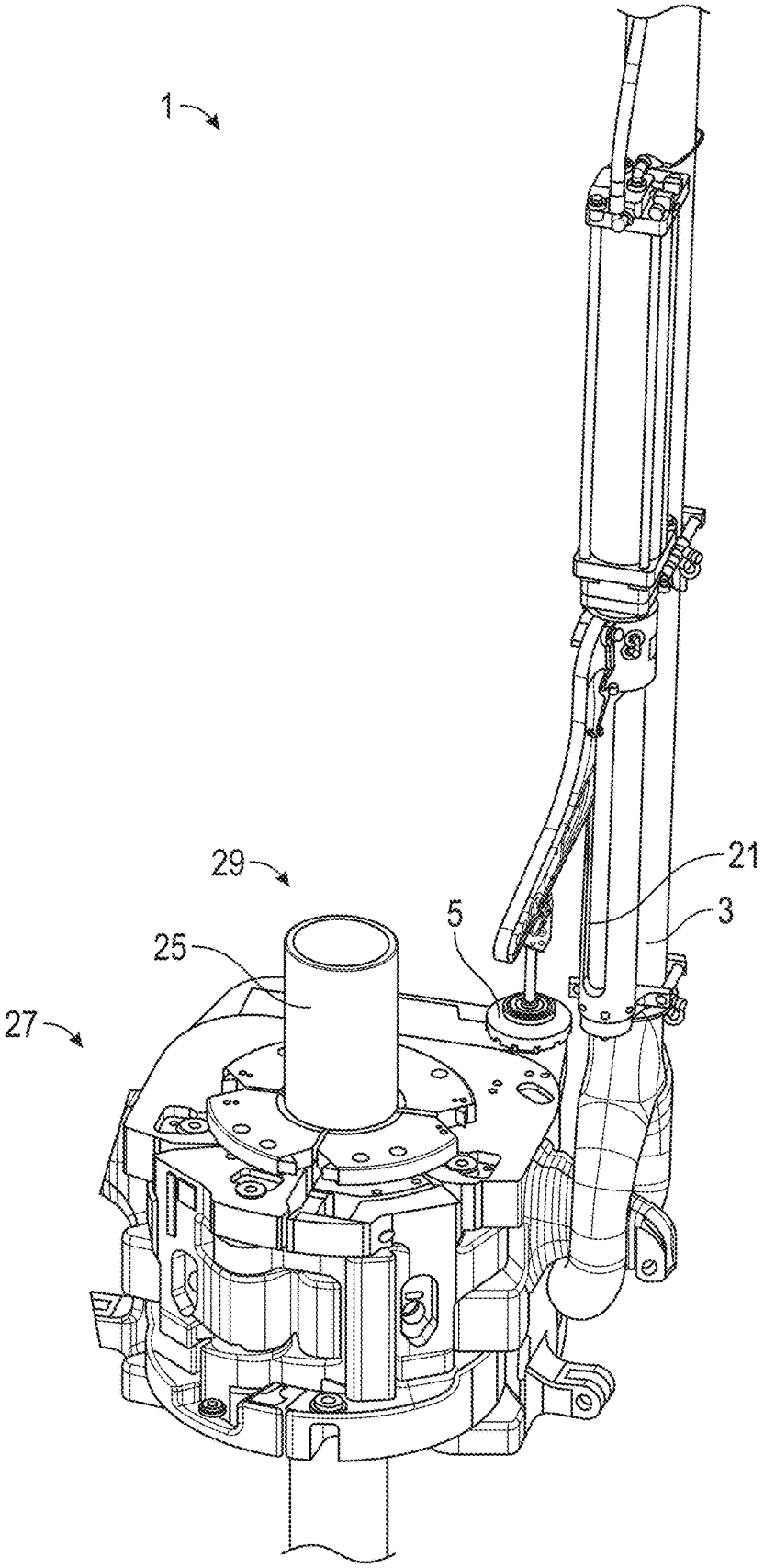
FIG. 3 shows the apparatus of FIGS. 1 and 2 together with a wired drill pipe held by an elevator wherein the connector head is in the decoupled position.
Figure 4:
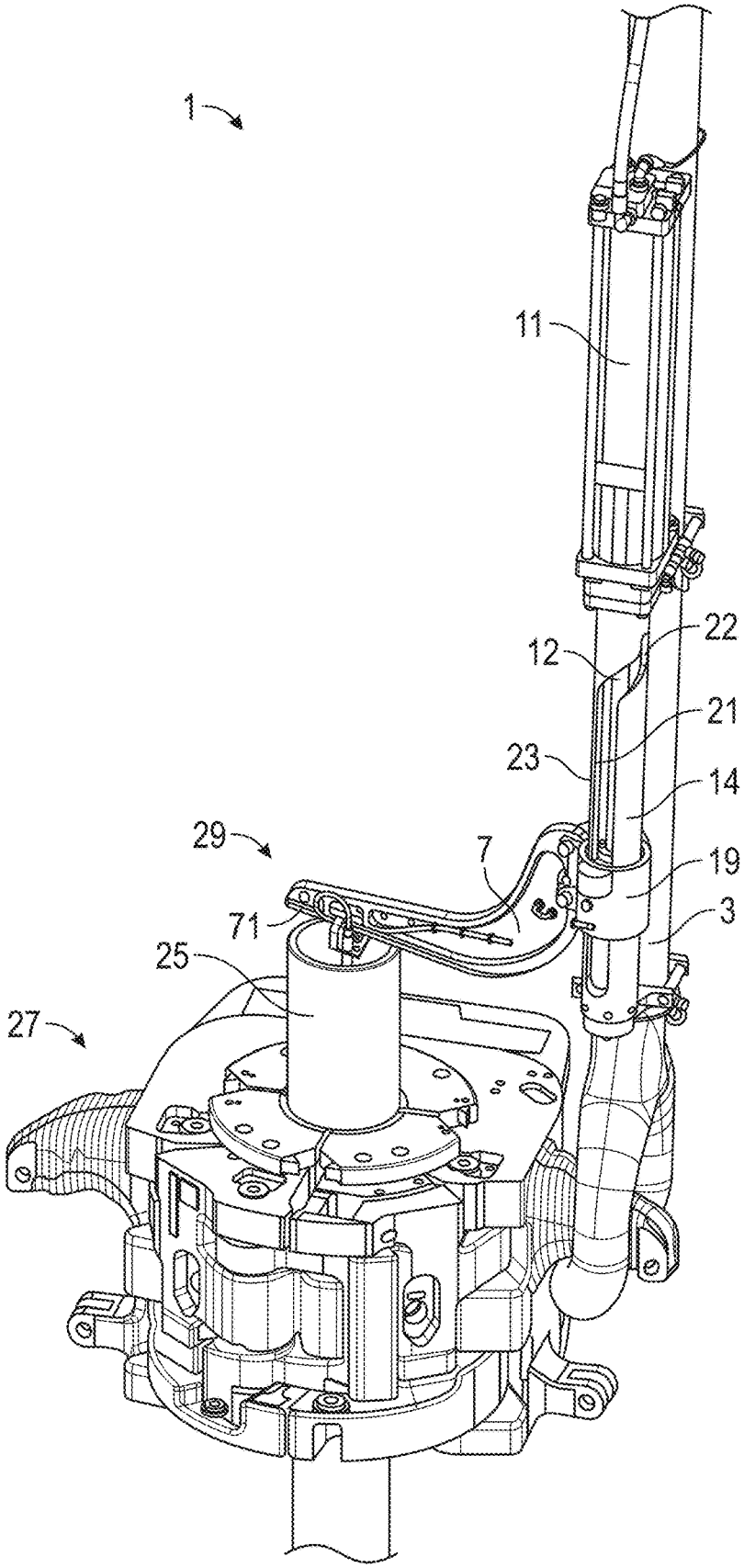
FIG. 4 shows the apparatus, elevator and wired drill pipe of 3, wherein the connector head is in the coupled position.

FIGS. 3 and 4 show the apparatus 1 of FIGS. 1 and 2 together with an elevator 27 holding a wired drill pipe 25. The elevator 27 is held by the drilling bail 3. FIG. 3 shows the decoupled position of the connector head 5, wherein the connector head 5 is decoupled from the end 29 of the wired drill pipe 25 and displaced form the axis of the wired drill pipe 25, while FIG. 4 shows the coupled position of the connector head 5 when it is coupled to the end 29 of the wired drill pipe 25. The connector head 5 is not visible in FIG. 4, as the coupling between the connector head 5 and the end 29 of the wired drill pipe 25 is inside the wired drill pipe 25. The shape of the groove 21, which is best seen in FIG. 4, determines the movement path of the connector head 5 when moving from the decoupled to the coupled position. In the upper portion 22, the groove 21 has a shape which is similar to a sigmoidal curve, whereby the base portion 19, the connector arm 7, and the connector head 5 are rotated around the axis of the cylindrical rod housing 14 while being displaced axially along said axis. The apparatus 1 is positioned such that at the end of the rotation of the base portion 19 around the cylindrical rod housing 14, the connector head 5 is located along the axis of the wired drill pipe 25. It may be noted that the connector head 5 is slidably attached to a rail 71 on the connector arm 7, such that the connector head 5 may be positioned at different distances from the hydraulic cylinder 11 by sliding along the rail 71. The apparatus 1 can thereby be used with different types of elevators 27. In the lower portion 23, the groove 21 is parallel to the axis of the cylindrical rod housing 14, whereby the base portion 19, connector arm 7, and connector head 5 are displaced in parallel to said axis. Since the connector head 5 is located along the axis of the wired drill pipe 25 when the base portion 19 of the connector arm 25 is in the lower portion 23 of the groove 21, movement of the base portion 19 along the lower portion 23 of the groove 21 causes the connector head 25 to have the correct orientation relative to the end 29 of the wired drill pipe 25 upon coupling, regardless of how much the end 29 of the wired drill pipe 25 protrudes up from the elevator 27, at least within the span of the straight lower portion 23 of the groove 21. A successful coupling between the connector head 5 and the wired drill pipe 25 may be easily and automatically determined, for example when data are received or via force measurement in the connector head 5 or connector arm 7. When coupling is detected, the movement of the base portion 19 along the lower portion of the groove 23 is stopped. In this way the apparatus 1 functions automatically with different type of elevators 27, and with wired drill pipes 25 which have different protrusion up from the elevator 27.

It should be noted that the above-mentioned embodiments illustrate rather than limit the apparatus or the method of the present description, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. An apparatus for coupling and decoupling a connector head to and from an end of a wired drill pipe held by an elevator, the apparatus comprising:

an actuator configured to move the connector head between a coupled position, where the connector head is coupled to the end of the wired drill pipe, and a decoupled position, where the connector head is displaced from the longitudinal axis of said wired drill pipe, wherein the actuator is configured to move the connector head in parallel with the longitudinal axis of the wired drill pipe before moving it away from said wired drill pipe when decoupling the connector head from the wired drill pipe, and to move the connector head into the longitudinal axis of the wired drill pipe before moving it in parallel with said longitudinal axis when coupling the connector head to the wired drill pipe, wherein the connector head is connected to one end of a connector arm, the other end of the connector arm being connected to the actuator, wherein the actuator comprises a hydraulic cylinder comprising a piston inside and a piston rod protruding out of the hydraulic cylinder and into a cylindrical rod housing, wherein the connector arm comprises a base portion which is slidably connected to the cylindrical rod housing and rotatably connected to the piston rod, wherein the cylindrical rod housing is provided with a groove, wherein an inward protrusion on the base portion engages the groove in the cylindrical rod housing, and wherein the groove, with which the inward protrusion on the base portion is engaged, determines rotation of the base portion and the connector arm around an axis of the cylindrical rod housing as the piston is being displaced along an axis of the hydraulic cylinder, wherein the groove comprises an upper curved portion and a lower straight portion.

2. The apparatus of claim 1, wherein the apparatus is configured to be attached to a drilling bail.

3. The apparatus of claim 1, wherein the apparatus comprises a safety mechanism for quickly moving the connector head from the coupled position to the decoupled position.

4. The apparatus of claim 3, wherein the safety mechanism comprises a gas accumulator.

5. A method for using the apparatus of claim 1 to couple the connector head to the end of the wired drill pipe held by the elevator, comprising:

moving the connector head from the decoupled position where the connector head is displaced from the longitudinal axis of the wired drill pipe to the position along the longitudinal axis of the wired drill pipe and displaced from said wired drill pipe, and moving the connector head along the longitudinal axis of the wired drill pipe onto the end of said wired drill pipe.

6. The method of claim 5, wherein moving the connector head from the decoupled position where the connector head is displaced from the longitudinal axis of the wired drill pipe to the position along the longitudinal axis of the wired drill pipe and displaced from said wired drill pipe comprises transforming a translational movement of the actuator into a translational and rotational movement of the connector head.

7. The method of claim 6, wherein moving the connector head from the decoupled position where the connector head is displaced from the longitudinal axis of the wired drill pipe to the position along the longitudinal axis of the wired drill pipe and displaced from said wired drill pipe and moving the connector head along the longitudinal axis of the wired drill pipe onto the end of said wired drill pipe comprises performing the translational movement of the actuator.

8. The method of claim 5, wherein the apparatus of claim 1 moves the connector head between the coupled position, where the connector head is coupled to the end of the wired drill pipe, and the decoupled position, where the connector head is displaced from the longitudinal axis of said wired drill pipe.

9. The method of claim 8, wherein the apparatus moves the connector head in parallel with the longitudinal axis of the wired drill pipe before moving it away from said wired drill pipe when decoupling the connector head from the wired drill pipe, and moves the connector head into the longitudinal axis of the wired drill pipe before moving it in parallel with said longitudinal axis when coupling the connector head to the wired drill pipe.

* * * * *